US008950416B1

(12) United States Patent
Spellman

(10) Patent No.: US 8,950,416 B1
(45) Date of Patent: Feb. 10, 2015

(54) REMOVABLE AND COLLAPSIBLE COVER SYSTEM

(71) Applicant: Michael J. Spellman, White Lake, MI (US)

(72) Inventor: Michael J. Spellman, White Lake, MI (US)

( * ) Notice: Subject to any disclaimer, the term of this patent is extended or adjusted under 35 U.S.C. 154(b) by 3 days.

(21) Appl. No.: 13/859,193

(22) Filed: Apr. 9, 2013

(51) Int. Cl.
*E04H 15/06* (2006.01)
*B63B 17/02* (2006.01)

(52) U.S. Cl.
CPC ..... *B63B 17/02* (2013.01)
USPC ..... 135/88.01; 114/361

(58) Field of Classification Search
USPC ..... 135/88.01; 43/1–3; 114/361
See application file for complete search history.

(56) References Cited

U.S. PATENT DOCUMENTS

| | | | | | |
|---|---|---|---|---|---|
| 1,454,220 | A | | 5/1923 | Hall | |
| 1,519,691 | A | * | 12/1924 | Moz Mizrahi | 114/361 |
| 2,797,697 | A | * | 7/1957 | Gilmore, Jr. et al. | 114/361 |
| 2,864,391 | A | * | 12/1958 | Stark | 114/361 |
| 3,192,542 | A | | 7/1965 | Mills, II | |
| 3,422,829 | A | * | 1/1969 | Adams, Jr. | 114/361 |
| 3,896,832 | A | * | 7/1975 | Montoya | 114/361 |
| 4,075,723 | A | | 2/1978 | Bareis et al. | |
| 4,292,913 | A | | 10/1981 | Siebert et al. | |
| 5,070,807 | A | * | 12/1991 | Lewis | 114/361 |
| 5,343,824 | A | | 9/1994 | Floyd | |
| 5,944,039 | A | * | 8/1999 | Bergeron | 135/119 |
| 6,129,034 | A | | 10/2000 | Santa Cruz et al. | |
| 6,286,449 | B1 | * | 9/2001 | Giffin et al. | 114/361 |
| 6,588,361 | B2 | | 7/2003 | Biedenweg | |
| 6,659,035 | B2 | | 12/2003 | Treytiak | |
| 6,725,871 | B1 | * | 4/2004 | Shearer et al. | 135/88.01 |
| 6,789,495 | B2 | | 9/2004 | Brower et al. | |
| 6,968,800 | B1 | * | 11/2005 | Becht | 114/361 |
| 7,032,532 | B2 | * | 4/2006 | Brooks et al. | 114/361 |
| 7,143,717 | B2 | | 12/2006 | Murphy | |
| 8,001,919 | B2 | | 8/2011 | Shearer et al. | |
| 8,757,185 | B1 | * | 6/2014 | Muzzio | 135/88.01 |
| 2007/0095271 | A1 | | 5/2007 | Yang | |
| 2011/0180119 | A1 | * | 7/2011 | Clampitt | 135/88.01 |

* cited by examiner

*Primary Examiner* — Noah Chandler Hawk
(74) *Attorney, Agent, or Firm* — Carrier Blackman & Associates, P.C.; Joseph P. Carrier; William D. Blackman

(57) ABSTRACT

A collapsible and removable cover for an object, including a collapsible, lightweight, waterproof cover member configured to cover a portion of the object, a lightweight support frame which is configured to be manipulated by a user between an expanded operative shape and a collapsed storage shape, and which connects to the cover member in the expanded operative shape such that the support frame and the cover member jointly form a self-supporting cover unit having a stable configuration, and retainers which are configured to secure parts of the support frame to the object. The retainers include first portions which are configured to be secured to the object and second portions which securely connect to the parts of the support frame, and the retainers function as a sole source of connection between the cover unit and the object.

13 Claims, 9 Drawing Sheets

REMOVABLE AND COLLAPSIBLE COVER SYSTEM

CROSS-REFERENCE TO RELATED APPLICATIONS

None.

BACKGROUND OF THE INVENTION

1. Field of the invention

The present invention relates to removable and collapsible cover system which may be conveniently secured on a boat or other object for protection from damage due to sunshine, wind, water, and other foreign elements. More particularly, the invention relates to such a cover system which can reliably protect a boat or other object over a relatively long time period, is lightweight, can be collapsed into a compact size, and can be easily manipulated between operative and storage positions thereof by one person.

2. Description of the Background Art

There are many known removable boat covers, including some which completely cover the upper portions of boats for storage and/or moving purposes, and others which only cover parts of the upper portions of boats and/or are not intended for storage and moving purposes, such as cockpit covers, cabin covers, and hunting blinds. The present invention is primarily focuses on covers which are used for storage and moving purposes, but aspects of the present invention can also be applied to other types of boat covers and other object covers.

Examples of some of some removable boat covers are disclosed in the following U.S. Pat. Nos. 1,454,220, 3,192,542, 4,075,723, 4,292,913, 5,343,824, 6,129,034, 6,588,361, 6,659,035, 6,789,495, 7,143,717, and 8,001,919, and published patent application No. 2007/0095271 A1, some of which are discussed further below.

For purposes of reliably protecting boats from damage due to sunshine, wind, water, and other foreign elements over an extended period of time the covers must be securely attached to the boats so as to withstand the forces of wind, rain, waves, etc. Some examples are briefly discussed below, each of which includes some means for securing the covers to boats.

For example, the cover in Pat. No 1,454,220 includes numerous grommets spaced along the periphery of the cover, elongate rails which are secured on outer opposite sides of the boat/canoe, and an elongate rope which is extended through each of the grommets and around the rails in alternating manner; the cover in each of Pat. Nos. 3,192,542 and 6,588,361 includes metal/plastic clips fixed in spaced relation around the periphery of the fabric cover, and wherein the clips are adapted to snap fit or otherwise secure to the upper rails of the boats; the cover in Pat. No. 5,343,824 includes interlocking rails on opposite sides of the boat/canoe, each including a base which is fixed to the outer side of the boat via screws or bolts, an intermediate member that secures/slides over the base, and an outer member which slides over the intermediate member such that the peripheral edge of a flexible cover is trapped/fixed between the intermediate and outer members; the cover in Pat. No. 4,292,913 includes bumper rails which are fixed to the outer sides of the boat, and a plurality of clips having first ends that can be selectively attached to the rails and second ends which can be selectively attached to openings defined in spaced relation around the periphery of a cover using straps; the cover in Pat. No. 4,075,723 is secured to a boat using long ropes that extend through grommets provide along the periphery on one side of the cover and are extended around the hull of the boat and connected to grommets on the other side of the cover, and also includes flexible poles that are bent into an arc shape and have ends secured in pockets provided on the inside periphery of the cover, as well as tensioning cables disposed in conjunction with the poles and pockets; the cover in Pat. No. 6,129,034 is secured near to a boat using a combination of means, including a long flexible cord disposed in a sleeve provided along the periphery of the cover and the ends of which may be tied to transom eyes provided on the exterior of the boat, multiple sleeves provided laterally across the cover for having ribs disposed therein and having pockets at the ends thereof which may be secured to inner side panels of the boat using adhesive and/or screws, resilient bungee cords with hooks at opposite ends for being connected between the cover and the inner side panels or of the boat's transom eyes, and a rope connected between one of the ribs and the boat's motor for tensioning the cover; the cover in Pat. No. 6,659,035 is also secured near the upper rails of a boat using flexible cords disposed in pockets/sleeves at the periphery of the cover, as well as stay-put fasteners attached to the sides of the boat and bungee loops which are connected to the cover and can be extended over the stay-put fasteners; the cover in Pat. No. 7,143,717 includes special rub rails on opposite outer sides of a boat which securely receive numerous fasteners secured about the periphery of the cover and are rotatable 90° once inserted in the rub rails to be locked thereto; the cover in patent publication 2007/0095271 simply includes an adjustable cable/rope disposed in a sleeve/pocket formed around the periphery of the cover and can be adjusted in length for being secured under the upper rail of a boat; and the cover in Pat. No. 8,001,919 uses hook-and-loop type fastener material provided around the periphery of the cover and mating material at appropriate portions of the boat.

As will be appreciated, there are a variety means used for securing these known covers to the boats. Some are quite simple, e.g., the cover in publication 2007/0095271 primarily involving ropes/cords extend around the cover peripheries and tied tight when fitted over the boats' upper rails. This is problematic in that a simple tied cord tends not to be reliable, especially when exposed to severe conditions over longer periods. Some are quite involved, e.g., the covers in Pat. Nos. 7,143,717, 5,343,824, and 1,454,220, which include special rails attached to the boats and which are use for securing peripheral edges of the covers, and the cover in Pat. No. 6,129,034 involving several different securing means. While these securing means provide more reliable securement for the covers than the tied rope, they tend to be significantly more costly than the simple covers, and require relatively labor-involved procedures for attaching and removing the covers to/from boats. Others of the known covers are not particularly simple or complex, but also suffer from various drawbacks including insufficient reliability, insufficient durability, higher cost, etc.

The cover disclosed in Pat. No. 6,789,495 is referred to as "self-supporting" and includes a waterproof cover having shape-providing support rods connected thereto, but no means for actually securing the cover to a boat or any other object are disclosed.

Thus, although all of the known covers generally function to achieve their intended purposes, there are drawbacks associated with the known covers, including the inability of some covers to reliably protect boats from damage due to sunshine, wind, water, and other foreign elements over an extended period of time, particularly when the boats remain in water and are exposed to pounding of waves, cost and/or complexity of some of the covers, difficulty of installing and removing some covers, large size and/or weight of some covers, etc.

Hence, a need still exists in the art for an improved boat cover which is removable and collapsible, may be conveniently secured on a boat or other object for reliably protecting the boat or other object over a relatively long time period, is lightweight, can be collapsed into a compact size, can be easily manipulated between operative and storage positions thereof by a single person, and is relatively inexpensive.

SUMMARY OF THE INVENTION

The present invention provides an improved boat cover which meets the discussed need in the art.

According to a first aspect of the present invention there is provided a collapsible cover for an object such as a boat, comprising: a collapsible, lightweight, waterproof cover member configured to cover a portion of the object; a lightweight support frame which is configured to be manipulated by a user between an expanded operative shape and a collapsed storage shape, and which connects to the cover member such that the support frame and the cover member jointly form a self-supporting cover unit having a stable configuration; and retainers which are configured to secure parts of the support frame to the object; wherein the retainers include first portions which are configured to be secured to the object and second portions which securely connect to the parts of the support frame; and wherein the retainers function as a sole source of connection between the cover unit and the object.

The second portions of the retainers may elongated slots for securely receiving the parts of the support frame and locking mechanisms such as movable latches which prevent the parts of the support frame rods from becoming disengaged from the slots.

Such cover system according to the present invention is very advantageous because it not only functions to securely protect an object such as a boat from severe weather conditions over an extended period, but is also lightweight, can be easily assembled or disassembled and manipulated, and conveniently connected to and disconnected from a boat by a single person.

According to a second aspect of the present invention, in addition to the first aspect, the support frame includes a plurality of flexible, collapsible rods which are configured to be manipulated between operative and collapsed configurations thereof and connectors which connect ends of the flexible rods together, and the cover member is provided with receivers for securely receiving portions of the support frame rods thereto. Further, the support frame rods are configured to be constrained when the rods are connected to the cover member in the operative configurations thereof such that the rods become bent into curved shapes and maintain the cover member in an expanded, tensioned cover shape.

Such second aspect of the present invention is very advantageous because the support frame including a plurality of rods is relatively lightweight, inexpensive, and easily manipulatable between an expanded operative position thereof and a collapsed storage position, and when connected to the cover member it forms a very stable and reliable support which also tensions the cover member into a desired shape without requiring any special or additional means for tensioning.

According to a third aspect of the present invention, in addition to the first or second aspect, the second portions of the retainers include elongated slots for securely receiving the parts of the support frame and locking mechanisms which prevent the parts of the support frame rods from becoming disengaged from the slots. The locking mechanisms may include movable latches each of which is movable between a closed position which closes an opening of the associated slot, and an open position which permits a part of the support frame to be moved into and out of the associated slot.

Such retainers according to the third aspect of the present invention are advantageous because they provide a simple, convenient, quick, and reliable means for connecting the cover unit of the cover member and the support frame to the boat, even by a single person.

According to a fourth third aspect of the present invention, in addition to any of the first-third aspects, the object is an open top boat, the first portions of the retainers are configured to be secured near an upper opening of the boat, and the second portions of the retainers are configured to project outwardly of the boat upper opening so that when the parts of the support frame are secured to the retainers a periphery of the cover member extends substantially entirely outside of the boat at a level below the upper opening.

The fourth aspect of the present invention is very advantageous because the cover system including the cover unit and retainers reliably prevent the rain and other foreign matter from entering into the upper opening of the boat.

According to a fifth third aspect of the present invention, in addition to any of the first-fourth aspects, the cover member integrally includes fasteners for selectively connecting and disconnecting the support frame thereto. The fasteners may include sleeves and/or pockets in which portions of the support frame rods are disposed, and straps which may be secured around portions of the support frame.

The fifth aspect of the invention is advantageous because the integral fasteners permit the cover member to be quickly and conveniently connected to the support frame, and will not become displaced or lost when the cover system is disassembled.

According to a sixth aspect of the present invention, in addition to any of the second-fifth aspects, some of the frame rods may remain connected to the cover member in a collapsed position thereof, and some of the connectors which connect ends of the rods are hinged such that the rods may be moved between operative and storage positions thereof via the hinged connectors while connected to the cover member.

The sixth aspect of the invention is advantageous because work for assembling and disassembling the support frame to the cover member is reduced due to the fact that some of the rods remain connected to the cover member at all times, and such rods will not become displaced or lost when the cover system is disassembled.

For a more complete understanding of the present invention, the reader is referred to the following detailed description section, which should be read in conjunction with the accompanying drawings showing present embodiments of the invention. Throughout the following detailed description and in the drawings, like numbers refer to like parts.

Intent of Disclosure

Although the following disclosure offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found.

There have been chosen specific embodiments of a cover system according to the invention and specific alternative structures and modifications thereto, the embodiments chosen for the purposes of illustration and description of the structure and method of the invention are shown in the accompanying drawings forming a part of the specification.

DETAILED DESCRIPTION OF EXEMPLARY EMBODIMENTS OF THE INVENTION

First Embodiment-Overview

Figure 1:
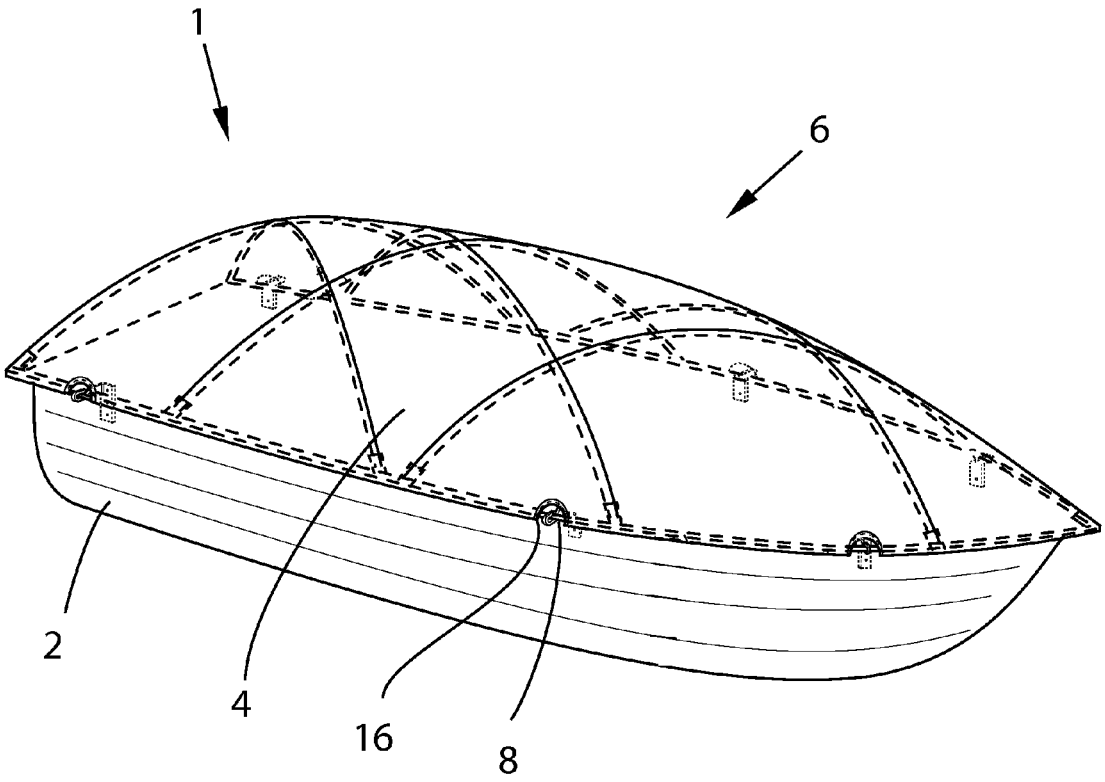
FIG. 1 is a front perspective view of a collapsible cover system according to an exemplary embodiment of the present invention which has been secured onto a boat.
Figure 2:
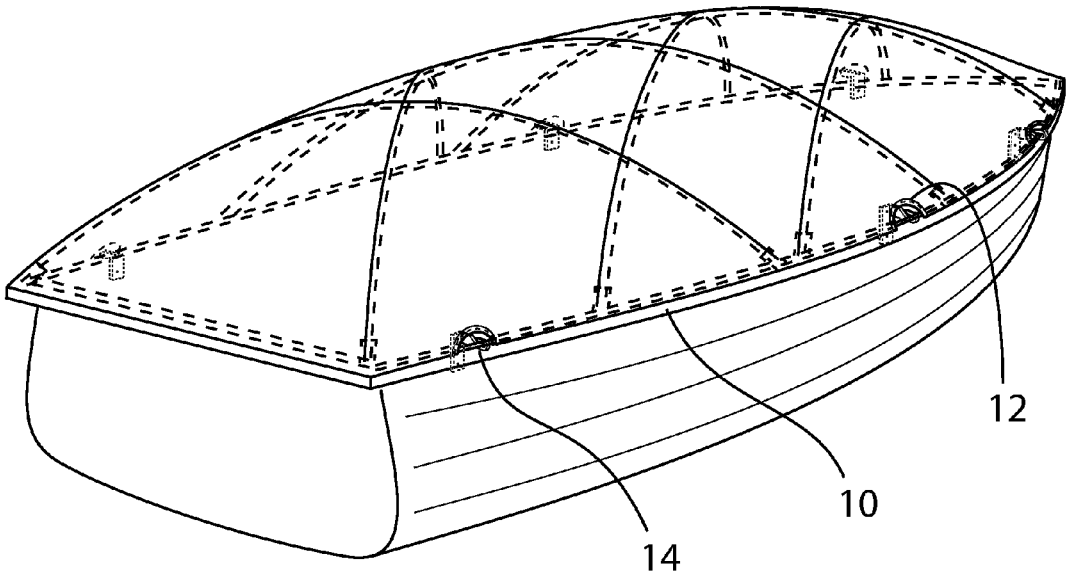
FIG. 2 is a rear perspective view thereof.

Referring to FIGS. 1-8, a removable and collapsible cover system 1 according to an exemplary embodiment of the invention is shown secured onto a boat 2 having an upper portion which is completely open. The cover system 1 can be used to cover any desired object, but the discussion hereafter will involve use of the cover system for covering the boat 2. The cover system generally includes a cover member 4 and a support frame 6 (mostly depicted with broken lines in FIGS. 1, 2, and 7) which connects to the cover member such that they jointly form a lightweight cover unit having a desired shape and which can be easily lifted and manipulated by a single person, as well as retainers 8 which are used to conveniently and securely fix the cover unit to the boat.

The Cover Unit Including the Cover Member and the Support Frame

The cover member 4 may be formed of a material such as nylon, canvas, vinyl, etc. which is desirably lightweight and waterproof, and yet sufficiently strong and durable to provide long lasting protection from sunlight, rain, and other foreign matters that could detrimentally affect the boat. The cover member may be formed to have a size and shape which corresponds to a given boat or to a given portion of a boat. For example, the cover member 4 in the depicted embodiment is sized and shaped to fully cover the upper portion of the boat. In the depicted embodiment, the peripheral edges of the cover member are shown disposed substantially adjacent to an upper rail 10 of the boat for ease of understanding, but preferably the peripheral edges of the cover should extend a short distance outwardly and downwardly of the upper opening of the boat for more surely preventing rain and other foreign matter from getting around the cover member and into the boat. Further, the cover member may be generally arched or concave shaped when the support frame 6 is connected thereto such that water from rain and waves, and other foreign matter will not collect on the cover, but will fall off the cover member outwardly of the boat by the force of gravity.

The cover member may be provided with various fastening means for connecting the support frame 6 thereto, such as elongate sleeves 16 disposed along the periphery of the cover member and/or extending through intermediate portions of the cover member for receiving portions of flexible rods/poles 14 therethrough, small recesses/openings 12 provided in spaced relation around the peripheral edge thereof for exposing small parts of the support frame 6 that will be engaged to the retainers 8, straps with hook-and-loop type fastening material provide thereon which can be secured around portions of the flexible rods/poles 14, etc. Of course, not all of the rods 14, 15 need be directly joined to the cover member 4 with a fastener, and some may be indirectly joined to the cover member via others of the rods 14, 15. Also, the support frame 6 may be provided with various connectors 18, 20, 22 for connecting flexible rods/poles 14 together. These will be discussed further below.

Figure 12:
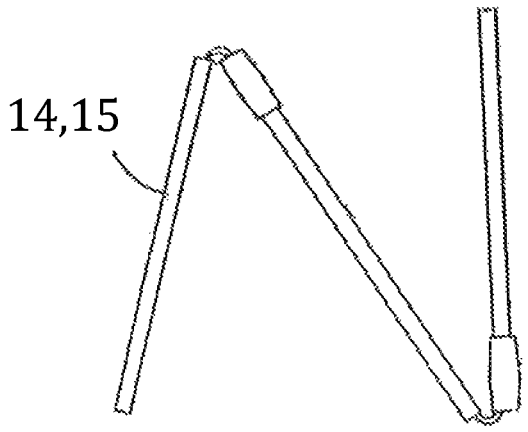
FIG. 12 is a general schematic view of either of flexible support rods 14, 15 of the support frame in a collapsed position thereof.

The support frame 6 may include a number of the long, flexible, and collapsible rods/ poles 14, 15 which are operatively connected to the cover member, such as shown in the drawings. For example, shock cord poles conventionally used with tents may be used as the support frame rods 14, 15. Shock cord poles can be readily manipulated between a collapsed compact size for storage such as shown in FIG. 12 and an operative long, flexible shape with high strength. Further, the support frame rods 14, 15 may be constructed to have specific lengths such that when they are assembled into their flexible, long operative shapes and secured to the cover member 4, they will give the cover member its desired shape, e.g., generally arched or concave shaped as discussed above. For such purpose, the lengths of the rods 14, 15 may be selected such that the rods become constrained at opposite ends thereof when connected to the cover member and to each other, and will flex/bow in appropriate directions, thereby tensioning the cover member into a desired, expanded shape without the need for any special or additional tensioning means.

In the depicted embodiment, for example, the frame 6 includes eight (8) of the support frame rods 14, 15, i.e., a first pair of long rods 14 provided respectively along opposite sides of the peripheral edge of the cover member and which will extend adjacent and substantially adjacent to the boat upper rail 10 at the opposite lateral sides of the boat 2 when the cover unit is connected to the boat; and a plurality (six in the depicted embodiment) of shorter rods 15 which extend diagonally across the cover member with opposite ends connected to the pair of long rods, respectively. The long rods 14 are spaced apart at the rear end of the boat and bend inwardly of the boat at front ends thereof. The short rods 15, which all have similar lengths, bend upwardly in an arched shape from the opposite ends thereof and cross others of the rods at intermediate portions of the cover member. Some of the short rods 15 extend from the rear to the front of the boat, and others of the short rods extend from the front to the rear of the boat.

In such an arrangement, the first pair of long rods 14 jointly function to shape the peripheral edge of the cover member and which will extend adjacent and substantially parallel to the boat upper rail 10 at the opposite lateral sides of the boat 2. Parts of this first pair of rods 14 may also be easily and reliably secured to the retainers 8 for conveniently connecting the cover unit to the boat as discussed further herein, according to an important aspect of the present invention. The short support rods 15 jointly function to shape the rest of the cover member in the arched or concave configuration, when connected to the long rods 14.

It is possible to use a greater or lesser number of the rods 14, 15 than the eight depicted rods, and to use rods having different lengths from what is depicted, depending on the size and shape of the cover member, as well as a user's desire. For example, it is possible: to include one or more additional support rods which extend from the peripheral edge at one lateral side of the cover member, upwardly to the middle of the cover member, and then downwardly to the peripheral edge on the opposite lateral side of the cover member, a rod could be provided at the peripheral edge of the cover member adjacent the rear or aft part of the boat, an arrangement may include more or less than six short rods 15, an arrangement may include short rods 15 of different lengths, an arrangement may include one or more short rods 15 extending laterally across the cover member rather than diagonally, an arrangement may include some of the short rods 15 which do not extend between the two long rods, etc.

Again, any appropriate means may be used to connect the rods 14, 15 of the support frame to the cover member 4 and to each other. However, the depicted embodiment uses a combination of sleeves 16 through which the support frame rods 14 and/or 15 are inserted, and connectors 18, 20, 22 which receive ends and/or portions of the rods 14, 15. Some of the sleeves 16 for securing the long rods 14 may be formed at the periphery of the cover member by folding the edge of the cover member over and sewing/bonding it to the adjacent portion of the cover member, or by using additional sections of nylon material or the like which are attached to the cover member 6 via sewing, bonding via adhesive and/or heat, etc., and shaped to receive the support frame rods 14 or sections of the rods inserted therethrough. Another type of fastener that may be used are straps 17 with hook-and loop fastener material, (see FIG. 11), which may be selectively secured around portions of the rods 14, 15. If the cover member includes fasteners comprising straps 17 with hook-and loop fastener material provide therewith, such straps can be secured to the cover member via sewing, bonding via adhesive and/or heat, etc., and would have an appropriate shape and length to be wrapped around portion(s) of the pole(s) 14 and/or 15.

The connectors 18, 20, 22, which are parts of the support frame 6, may be formed of plastic, metal, or other appropriate materials, and function to connect ends and/or other portions of all of the rods 14, 15 together in the operative position of the cover unit. Further, most or all of the connectors may remain attached to the long rods 14, and hence to the cover member, in the collapsed position of the cover unit, although the short rods 15 are typically removed from the connectors 20 when the cover unit is to be stored.

Figure 3:
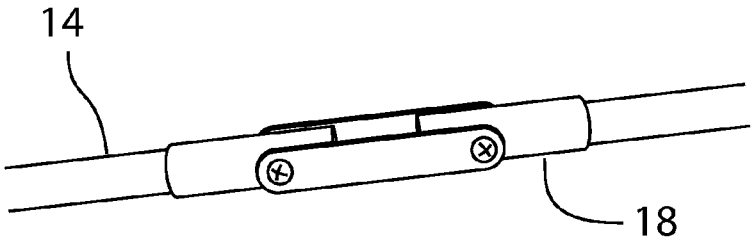
FIGS. 3-6 are perspectives views of connectors provided with a support frame of the cover system of FIG. 1 for securing together numerous flexible, collapsible rods which are also parts of the support frame.
Figure 4:
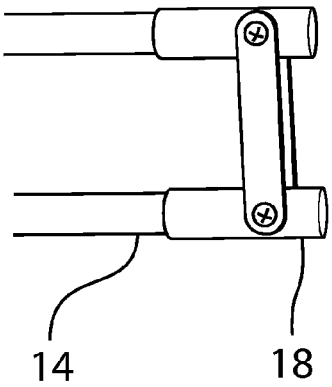
Figure 5:
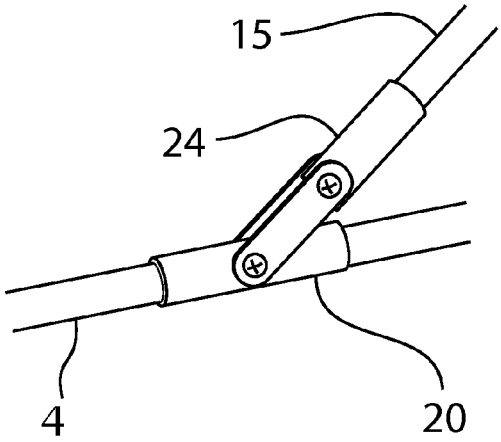
Figure 6:
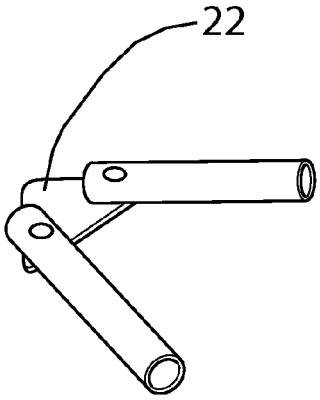
Figure 7:
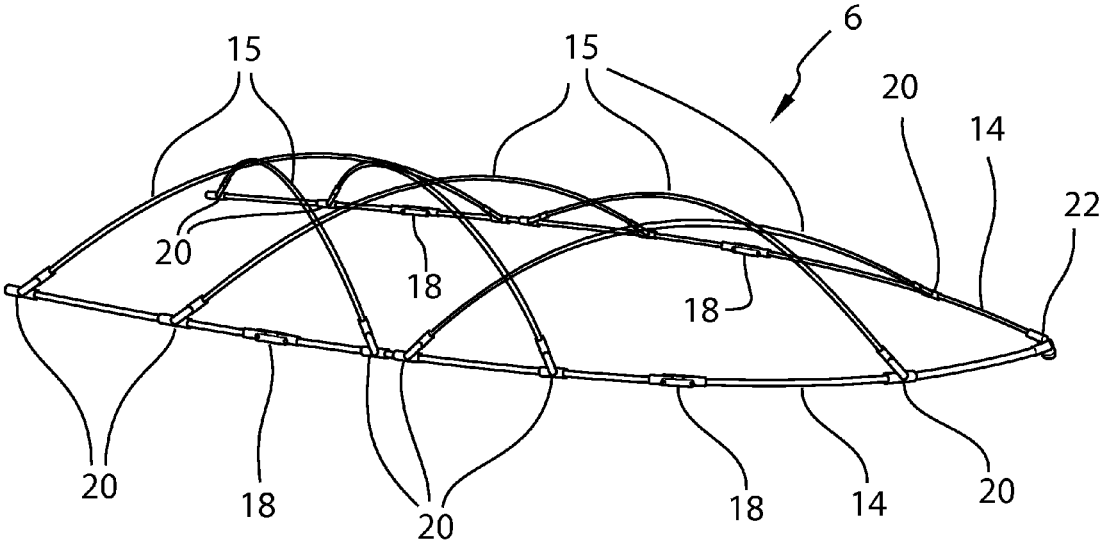
FIG. 7 is a perspective view of the cover member and the support frame connected thereto in an operative position thereof prior to being connected to retainers of the cover system provided on a boat.

Specifically, the connectors include: hinged connectors 18 shown in Figures. 3-4 which connect portions of the long rods 14 extending along peripheral edges of the cover member and permit the long rods 14 to remain may be secured to the cover member when the cover member is folded into its storage position; connectors 20 shown in FIG. 5 which connect ends of the short rods 15 to sections of the long rods 14; and connector 22 shown in FIG. 6 which connects the front ends of the two long rods 14. Each of the long rods 14 may include one or more of the hinged connectors 18. For example, if each long rod includes two of the hinged connectors 18, such as shown in FIG. 7, then the cover member may be conveniently folded in three sections via the two hinges in the longitudinal direction of the long rods, if each long rod includes three of the hinged connectors 18 then the cover member may be conveniently folded in four sections via the three hinges in the longitudinal direction of the long rods, etc.

The connectors 20 each connect adjacent sections of one of the long rods 14 in axial, end-to-end fashion similar to the connectors conventionally provided to connect the foldable sections of shock cord poles, but additionally include another portion 24 which is pivotally connected thereto and which receives an end of one of the short rods 15. Thus, for example, six of the connectors 20 may be provided with each of the long rods 14 for connecting the long rods to ends of the six diagonally extending short rods, as shown in FIG. 7. The connectors 20 may also remain connected to the long rods 14 in operative and storage positions of the cover unit. In the operative position of cover unit the pivoting portions 24 receive the ends of the short rods 15 and direct the short rods appropriately along the cover member, and in the storage position of cover unit the pivoting portions 24 may be pivoted adjacent to the long rods 14.

The connector 22 connects the front ends of the long poles 14 together in a substantially V-shape corresponding to the front end of the boat. The connector 22 may be connected to the cover member, e.g., via sleeves or other fastening means provided at the front of the cover member, and may remain connected to the cover member or removed therefrom when storing the cover member.

While sleeves, straps, and connectors are used in the depicted embodiment, it is possible to use other and/or additional fastening means to secure the cover member and the support frame together. Again, for example, the hook-and-loop fastening straps 17 and/or cords may be connected to the cover member for being secured around portions of the support frame, grommets may be provided to the cover member such that portions of the support frame rods 14, 15 may be extended therethrough, etc.

According to another important aspect of the present invention, the cover unit jointly formed by the cover member and the support frame connected thereto in the depicted embodiment is a relatively lightweight and stable structure which can be conveniently lifted and manipulated by a single person for being connected to and disconnected from the retainers 8 provided on the boat. Further, the cover member 4 and the support frame 6 in the present embodiment are structured such that they are conveniently compact in the storage positions thereof, e.g., they can fit in a small sack that a single person can carry, but can be easily assembled from their storage positions into the operative cover unit in a matter of a few minutes by a single person.

As depicted, the support frame 6 may be disposed substantially entirely on one side or face of the cover member 4 which faces toward the boat when the cover unit is secured to the boat, whereby the frame is substantially entirely concealed and protected by the cover member during use, except for small parts of the support frame rods that may be exposed in the small openings/recesses 12 formed in the peripheral edges of the cover member for being secured to the retainers 8. In the drawings, the small openings/recesses 12 are depicted with an enlarged size for ease of understanding, but may be made significantly smaller than depicted for the purpose of more reliably preventing water and other foreign matter from entering into the boat when the cover unit is disposed on the boat. Of course, it is possible to attach the cover member and support frame together such that some portion(s) of the cover member are exposed outwardly of the cover member when the cover unit is attached to the boat if so desired.

Also, while the support frame in the depicted embodiment includes a number of individual support rods 14, 15 that are attached to the cover member and are separable from each other for storage purposes, the support frame 6 may include a number of rods and/or other components which are pre-assembled together as an expandable and collapsible sub-assembly which a user may readily manipulate between an operative expanded shape which is then appropriately connected to the cover member 4, and a collapsed shape for storage.

The Retainers

Figure 8:
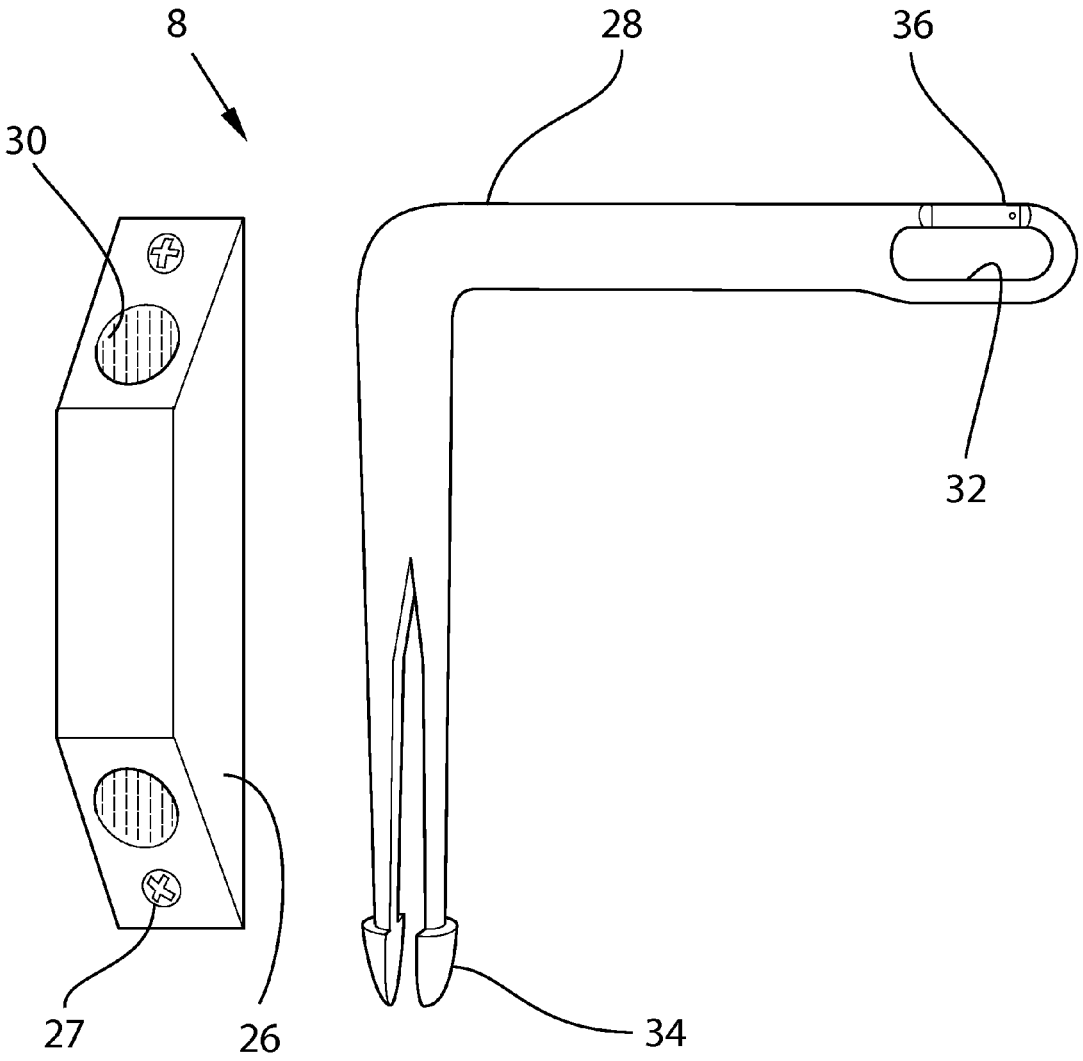
FIG. 8 is an enlarged perspective view of components of an embodiment of a retainer of the cover system in FIG. 1.

Referring the FIG. 8, there is shown a retainer 8 according to one embodiment of the present invention. The cover system 1 shown in FIGS. 1-2 includes a plurality, e.g., six, of such retainers, with three being disposed at each of the opposite lateral sides of the boat. The retainer 8 may include: a base 26 which may be fixed to the boat using appropriate fasteners, such as screws 27, near the boat's upper rail or gunwale 10, e.g., just below the upper rail on the inside wall of the boat as in the depicted embodiment; and a pivoting support bracket 28 having a first end which may be pivotally secured to the base 26 by being inserted through an opening 30 formed longitudinally through the base, and a second end with an elongated slot 32 formed therein which can securely receive a part of one of the long rods 14 engaged thereto. The second end of the bracket may also include a locking mechanism 36 associated with the slot 32 for securely retaining a part of one of the long rods 14 which has been engaged to the slot 32, e.g., a spring loaded pivot latch as depicted having one end which pivots inwardly of the slot 32 when pressed, but which automatically moves back to its closed under bias of a spring (not shown) when not pressed.

When the support bracket is in the operative position thereof it is a relatively easy procedure for a user to press the latch of the locking mechanism 36 inwardly of the slot 32, engage a part of one of the long support frame rods 14 in the slot, and release the latch for thereby securing the rod to the bracket. Release of the support frame rod 14 from the bracket is also easily effected by reversing the discussed procedure.

As depicted, the first end of the support bracket 28 may be forked and have an enlarged tip 34 such that the first end may be selectively inserted through the opening 30 of the base 26 and securely retained therein by the enlarged tip, and if desired, the two parts of the forked end may be pressed together for removing the bracket 28 from the base 26. When the support bracket 28 is secured to the base 16, the bracket may be readily moved/rotated between a storage position completely inside of the boat pivoted flat against the inside wall of the boat, and an operative position in which the bracket is raised with the first end thereof still extending through the opening 30 of the base, and then when the second end thereof having the slot 32 is raised above the boat upper rail 10 it is rotated to extend outwardly of the upper rail.

According to another important aspect of the present invention, connecting and disconnecting the assembled cover unit to/from the retainers provided on the boat 2 is also a relatively simple and quick procedure for a single person because the procedure may simply and exclusively involve connecting small parts of the support frame long rods 14 to the retainers. When securing the cover unit to a boat floating in the water and tied alongside a dock, a user may, for example: manipulate the brackets 28 into their operative positions in which the portions having the elongated slots 32 formed therein extend outside of the boat; lift the cover unit; step into the boat, and fit the small parts of the long rod 14 exposed in the recesses 12 of the cover member 4 on the far side of the cover unit (the side furthest from the dock) into the elongate slots 32 of the retainer support brackets on the far side of the boat; then step out of the boat (e.g., onto the adjacent dock) and fit the small parts of the long rod 14 exposed in the recesses 12 of the cover member 4 on the near side of the cover unit into the elongate slots 32 of the retainer support brackets on the near side of the boat. For removing the cover from the boat, the process is reversed.

It is possible to secure the cover unit to the boat using additional or alternative means besides connecting parts of the support frame to the retainers as discussed above, e.g., using various conventional securing means such as those discussed in the Background above. However, applicant has found that the connections between the retainers and parts of the support frame as in the exemplary embodiment discussed above are adequate for stably securing the cover unit to a boat over an extended period of time, even under adverse conditions such as high winds and rolling waves.

Figure 9:
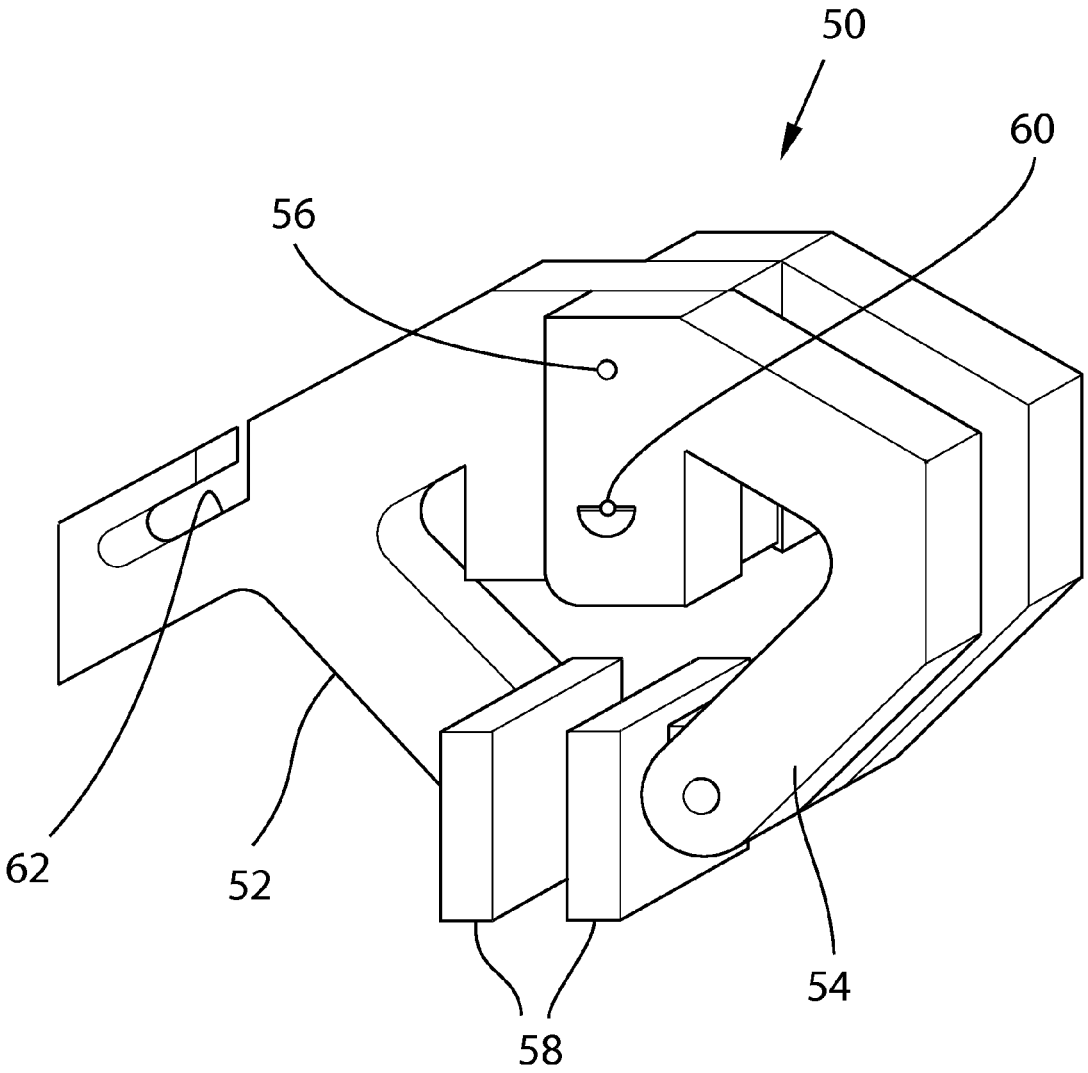
FIG. 9 is a perspective view of another embodiment of a retainer according to a cover system according to the present invention.
Figure 10A:
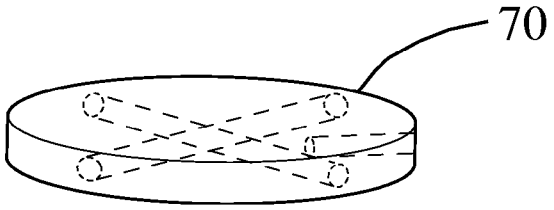
FIGS. 10A-10F are perspective views of various connector blocks that may be used to connect the rods of the support frame according to a modification of the invention.
Figure 10B:
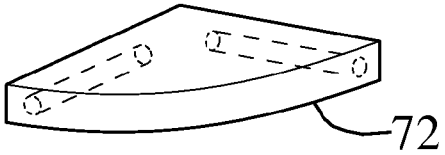
Figure 10C:
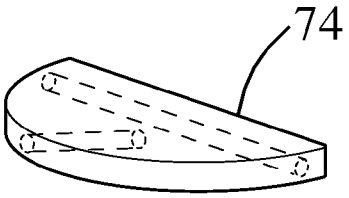
Figure 10D:
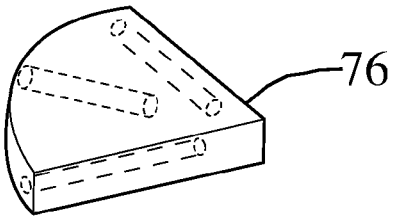
Figure 10E:
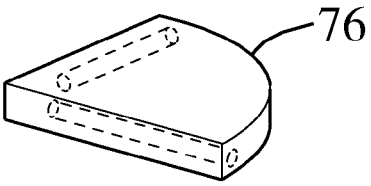
Figure 10F:
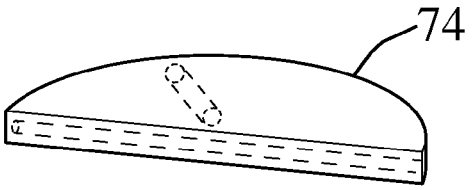

In the above-discussed embodiment, the retainers 8 include the bases which are secured to a wall of the boat 2 using the screws 27, but other types of retainers may be used which do not include any portions that are fixed to the boat using fasteners such as the screws 27 which permanently affect the boat. One such other type of retainer is shown in FIG. 9, which is in the form of a clamp 50 having opposing leg portions 52, 54 that are pivotally connected together via a pivot shaft 56. Lower ends of the leg portions have clamping faces 58 which oppose each other, and an open space is provided above the clamping faces such that the clamp can be readily secured to the upper rail 10 of the boat 2 by pivoting the legs 52, 54 away from each other, placing the clamp over the boat upper rail, and pivoting the legs towards each other such that the clamp face 58 of the leg portion 52 engages an outer surface of a wall of the boat, the clamp face 58 of the leg portion 54 engages an inner surface of the wall of the boat, and the upper rail 10 extends through the open space above the clamp faces. Indicated at 60 is a locking pin which may be selectively inserted through aligned openings formed in the leg portions to secure the clamp 50 in its operative clamped position, and removed from the aligned openings to permit the leg portions to pivot away from each other. The leg portion 52 has a projection with an elongated slot 62 and locking mechanism that function in the same manner as the slot 32 and locking mechanism 36 in the bracket 28 of the retainer 8 in the embodiment shown FIG. 8.

A cover system including the retainer clamps 50 according to this embodiment functions substantially the same as the cover system 1 in the embodiment of FIGS. 1-8 except that the retainer clamps 50 may be installed and removed for each use, rather than remaining fixed to the boat 2, such as the retainers 8. Otherwise, the cover system including the retainer clamps 50 achieves essentially the same advantages as the cover system including the retainers 8.

Although the present invention has been described herein with respect to a present embodiment thereof, the foregoing description may be intended to be illustrative, and not restrictive. Those skilled in the art will realize that many modifications of the present exemplary embodiments could be made which would be operable and would achieve the same advantages as achieved by the exemplary embodiments. All such modifications, as well as equivalents thereof, which are within the scope of the appended claims, are intended to be within the scope and spirit of the present invention as reflected b the claims presented herein.

One possible modification is to replace some or all of the connectors 18, 20, 22 with other types of connectors that maybe secured to the rods and perhaps to the cover member 4 as well. For example, FIGS. 10A-10F show support blocks 70, 72, 74, 76 having formed therein recesses for receiving ends of the rods and/or openings through which the rods are extended. The support blocks 70, 72, 74, 76 may be formed of plastic, wood, or other appropriate materials, and may be secured to the frame rods via the recesses and openings. The blocks may also be secured to the cover member 4 by any appropriate means, e.g., by being placed in reinforced pockets formed at appropriate locations of the cover member, via adhesive bonding, using hook- and-loop fastening straps, etc. As depicted, the blocks 70-76 may have different shapes based on the parts of the support rods 14 they are to have operatively connected thereto, and based on portions of the cover member 4 to which they are secured. Also, in the depicted embodiment, each of the blocks 70-76 connects to at least two of the support frame rods 14, and like the connectors 18, 20, 22, the blocks operatively link all of the rods together.

Figure 11:
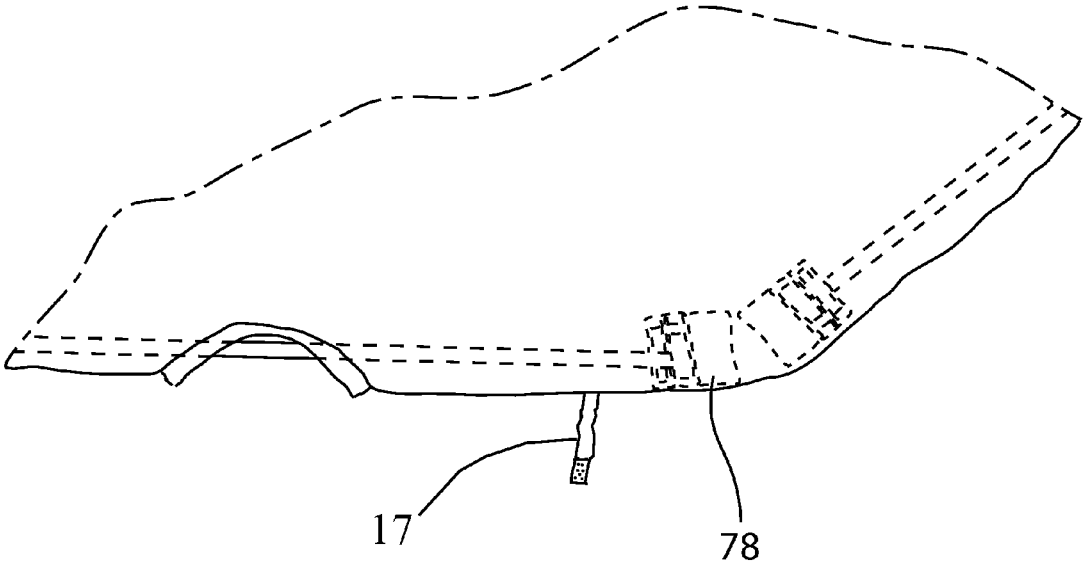
FIG. 11 is a perspective view of a modification to the cover member whereby it has pockets formed therein for receiving ends of two of the support frame rods.

Another possible modification is shown in FIG. 11. As shown a front portion of the cover member 4 may be formed with a pair of pockets 78, each of which is shaped to receive one end of one of the long rods 14 of the frame. These pockets may replace the connector 22.

I claim:

1. A collapsible and removable waterproof cover for a boat having an open upper portion bounded by a gunwale of the boat, comprising:

a collapsible, lightweight, waterproof cover member configured to fully cover the entire opening defined by the open upper portion of the boat;

a lightweight support frame which is configured to be manipulated by a user between an expanded operative shape and a collapsed storage shape, and which connects to the cover member such that the support frame and the cover member jointly form a self-supporting cover unit having a stable configuration when the frame is in its expanded operative shape; and retainers which are configured to be connected only to the boat for support and to selectively receive parts of the support frame for securing the self-supporting cover unit to the boat;

wherein the retainers include first portions which are configured to be connected to the boat and second portions which extend from the first portions and securely receive the parts of the support frame, wherein the support frame includes a plurality of flexible, collapsible rods which are configured to be manipulated between operative and collapsed configurations thereof, including first rods that connect and extend along an outer periphery of the cover member in a longitudinal direction of the cover member, and second rods which extend between the first rods and engage an intermediate portion of the cover member, wherein the first portions of the retainers are configured to be secured near the gunwale of the boat, and the second portions of the retainers are configured to project outwardly of the boat's gunwale so that when the parts of the support frame are secured to the retainers a periphery of the cover member extends substantially entirely outwardly of sides of the boat at a level below the open upper portion, and wherein the second portions of the retainers include elongated slots oriented transverse to and receiving therein parts of the first rods of the support frame as the only connection between the cover unit and the retainers.

2. The collapsible and removable waterproof cover according to claim 1, wherein the support frame further includes connectors which interconnect the rods.

3. The collapsible and removable waterproof cover according to claim 2, wherein some of the connectors remain connected to the cover member in a storage position of the cover member.

4. The collapsible and removable waterproof cover according to claim 2, wherein the connectors interconnect all of the support frame rods.

5. The collapsible and removable waterproof cover according to claim 1, wherein the support frame rods are configured to be constrained when the rods are connected to the cover member in the operative configurations thereof such that the rods become bent into curved shapes and maintain the cover member in a concave, tensioned shape.

6. The collapsible and removable waterproof cover according to claim 1, wherein in the self-supporting cover unit the second rods maintain the intermediate portion of the cover member in a substantially arched shape sloping downwardly toward the periphery of the cover member.

7. The collapsible and removable waterproof cover according to claim 1, wherein the cover member is provided with fasteners for selectively connecting and disconnecting the support frame thereto, the fasteners include one or more of sleeves through which portions of the support frame can be extended, pockets in which portions of the support frame may be disposed, blocks having recesses and/or openings defined therein which receive portions of the support frame, and straps having hook-and-loop fastening material thereon.

8. The collapsible and removable waterproof cover according to claim 1, wherein the second portions of the retainers further include locking mechanisms which prevent the parts of the support frame first rods from becoming disengaged from the elongated slots of the second portions of the retainers in which the parts are received.

9. The collapsible and removable waterproof cover according to claim 8, wherein the locking mechanisms include movable latches each of which is movable between a closed position which closes the associated elongated slot, and an open position which permits the part of the associated support frame first rod to be moved into and out of the associated elongated slot.

10. The collapsible and removable waterproof cover according to claim 1, wherein the retainers function as a sole source of connection between the cover unit and the boat.

11. The collapsible and removable waterproof cover according to claim 1, wherein the support frame further includes connectors which interconnect the rods; and wherein some of the connectors remain connected to the cover member in a storage position of the cover member.

12. The collapsible and removable waterproof cover according to claim 1, wherein when the cover unit is secured to the retainers and the retainers are secured to the boat, the parts of the first rods are movable relative to the elongated slots in which they are received.

13. The collapsible and removable waterproof cover according to claim 1, wherein the elongated slots extend laterally outwardly of the outer periphery of the cover member when the cover unit is secured to the retainers.

* * * * *